US007338151B1

(12) United States Patent
Samura

(10) Patent No.: US 7,338,151 B1
(45) Date of Patent: Mar. 4, 2008

(54) HEAD FOR INK-JET PRINTER HAVING PIEZOELECTRIC ELEMENTS PROVIDED FOR EACH INK NOZZLE

(75) Inventor: Hideo Samura, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/343,092

(22) Filed: Jun. 30, 1999

(30) Foreign Application Priority Data

Jun. 30, 1998 (JP) ..... 10-201204

(51) Int. Cl.
*B41J 2/045* (2006.01)

(52) U.S. Cl. ..... 347/70; 347/42; 347/71

(58) Field of Classification Search ..... 347/68–72, 347/40, 42, 85–86; 310/358, 328, 365, 366
See application file for complete search history.

(56) References Cited

U.S. PATENT DOCUMENTS 4,189,734 A 2/1980 Kyser et al.
4,216,483 A 8/1980 Kyser et al.
4,611,219 A * 9/1986 Sugitani et al. ..... 347/40
4,680,595 A * 7/1987 Cruz-Uribe et al. ..... 347/40
4,742,365 A * 5/1988 Bartky et al.
4,879,568 A 11/1989 Bartky et al.
4,887,100 A 12/1989 Michaelis et al.
4,992,808 A 2/1991 Bartky et al.
5,003,679 A 4/1991 Bartky et al.
5,345,139 A * 9/1994 Gururaja et al. ..... 310/358
5,414,245 A * 5/1995 Hackleman ..... 219/548
5,512,796 A * 4/1996 Paton ..... 310/358
5,530,465 A * 6/1996 Hasegawa et al. ..... 347/70
5,678,290 A 10/1997 Good
5,790,156 A 8/1998 Mutton et al.
5,825,121 A * 10/1998 Shimada ..... 347/68 X
6,099,111 A * 8/2000 Chang ..... 347/71

(Continued)

FOREIGN PATENT DOCUMENTS

EP 0431338 A2 6/1991

(Continued)

OTHER PUBLICATIONS

European Search Report dated Aug. 24, 1999.

*Primary Examiner*—Lam Son Nguyen
(74) *Attorney, Agent, or Firm*—McDermott Will & Emery LLP

(57) ABSTRACT

The present invention provides a line head for ink-jet printer capable of accomplishing a printing of high density and high quality, capable of achieving a high productivity with a simple construction, and capable of printing with multicolor inks (five colors or more). The line head for ink-jet printer comprises ink nozzle 5, ink passages 6, ink chambers 7, and a piezoelectric element 4 of ferroelectric substance for changing a capacity of the ink chambers to jet an ink from the ink nozzles through said ink passages, and in which a silicon substrate 1 is employed as a substrate on which the ink nozzles and ink passages are formed. A thin film of ferroelectric substance of said piezoelectric element is formed by applying a fine patterning to a gel thin film of ferroelectric substance which is obtained by introducing a photosensitive group into a precursor sol of ferroelectric substance formed by sol-gel method and by applying the precursor sol to a base.

5 Claims, 4 Drawing Sheets

U.S. PATENT DOCUMENTS 6,134,761 A * 10/2000 Usui ..... 347/71 X
6,217,158 B1 * 4/2001 Kanaya et al. ..... 347/70
6,290,340 B1 * 9/2001 Kitahara et al. ..... 347/70

FOREIGN PATENT DOCUMENTS

EP 0431338 A3 6/1991
EP 0736915 A1 10/1996
EP 0913359 A1 5/1999
JP 63-247051 10/1988
JP 63-252750 10/1988
JP 10-86365 * 4/1998
JP 10-211698 * 8/1998
JP 10-287468 * 10/1998

* cited by examiner

HEAD FOR INK-JET PRINTER HAVING PIEZOELECTRIC ELEMENTS PROVIDED FOR EACH INK NOZZLE

BACKGROUND OF THE INVENTION

1. Field of the Invention

The present invention relates to a line head for an ink-jet printer and, more particularly, to a line head of an ink-jet printer, in which capacity of an ink chamber filled with an ink is changed by a piezoelectric actuator and a required printing is performed with the ink-jetted at this moment from an ink nozzle through an ink passage. Such a line head is used in the form of being incorporated in various ink-jet printers such as word processor, facsimile, plotter.

2. Prior art

In the field of printers such as word processor, facsimile, plotter, ink-jet printers using a piezoelectric actuator have been already put into practical use, and there are several types of them.

As one type of the ink-jet printer, Kaiser type is known as is disclosed in the specifications of U.S. Pat. Nos. 4,189,734 and 4,216,483, etc., for example. The Kaiser type printer head is generally constructed in the following manner. That is, on a base of the printer head, separate ink passages branched from a common ink passage are provided toward injection nozzles. Further on the base of the printer head, a vibration plate is mounted in such a manner as to cover the separate ink passages. By vibrating this vibration plate flexibly, capacity of each ink passage is changed, and an ink is jetted toward a paper for each vibration of the vibration plate. To give a vibration driving force to the vibration plate, piezoelectric elements are secured to the vibration plate respectively at positions corresponding to the separate ink passages. By applying a voltage to a selected piezoelectric element, the piezoelectric element is displaced to vibrate the vibration plate at the portion. As a result, capacity of the separate ink passages at the portion corresponding to the vibration of the vibration plate is changed as mentioned above so that the ink is forced out of the injection nozzles.

Improvements have been further applied from various viewpoints to the ink-jet printer of Kaiser type of above construction, as is disclosed in the Japanese Laid-Open Patent Publication (unexamined) Sho 63-252750, specifications of corresponding U.S. Pat. Nos. 4,879,568, 4,887,100, 4,992,808, 5,003,679, 5,028,936, etc. It is said that such improved printer heads make it possible to provide an ink-jet printer capable of operating with a low energy and in which ink-jet density is high.

In the recent ink-jet printers, however, a higher level of printing speed and print quality have been increasing demanded, and with the line head of mentioned Kaiser type printer, it is rather difficult to satisfy such a demand of high printing speed and high print quality. In other words, under the conventional technology, there is a limit in applying a fine machining or processing to ink head, and it is now quite difficult to achieve a highly fine and delicate processing in the aspects of pitch and size of ink nozzles and ink passages.

In the prior art, it is also impossible to apply a fine processing to a piezoelectric element of ferroelectric substance. Moreover, under the conventional technology, as number of nozzles is small, reproducibility of original image is poor.

Under such circumstances, multicolor printing with five colors or more is difficult in the prior art. It is also difficult to achieve a high speed printing and a high print quality with the line head manufactured according to the prior art. In other words, if it becomes possible to provide a line head for ink-jet printer applied with a highly fine processing, multicolor printing will become possible, and not only a reproduction of original image with a high fidelity but also a high speed printing will be achieved.

SUMMARY OF THE INVENTION

Accordingly, an object of the present invention is to provide a line head for ink-jet printer capable of accomplishing a printing of high density and high quality, capable of achieving a high productivity with a simple construction, and capable of printing with multicolor inks (five colors or more).

To accomplish the foregoing object, in one aspect of the provides a line head for ink-jet printer comprising: a plurality of ink nozzle; ink passages each communicating to each ink nozzle separately; ink chambers each communicating to each ink passage separately; and a piezoelectric element of ferroelectric substance for changing a capacity of each ink chamber separately to jet an ink from said ink nozzles through said ink passages; in which a silicon substrate is employed as a substrate on which said ink nozzles and said ink passages are formed.

In another aspect, the invention above further provides the ink nozzles and the ink passages are processed finely using a silicon plasma etching method which is a design technique of integrated circuit.

In still another aspect, the invention provides a line head comprising: a plurality of ink nozzle; ink passages each communicating to each ink nozzle separately; ink chambers each communicating to each ink passage separately; and a piezoelectric element of ferroelectric substance for changing a capacity of each ink chamber separately to jet an ink from said ink nozzles through said ink passages; in which a thin film of ferroelectric substance of said piezoelectric element is formed by applying a fine patterning to a gel thin film of ferroelectric substance which is obtained by introducing a photosensitive group into a precursor sol of ferroelectric substance formed by sol-gel method and by applying said precursor sol to a base.

accord with the first aspect of the invention described above, it is possible to perform a micro-machining of an anisotropic silicon substrate, and therefore it is possible to apply a fine processing to the ink nozzles and the ink passages formed on the substrate.

Further, in accord with the last aspect of the invention described above, as the result of introducing the photosensitive group into the precursor sol of ferroelectric substance derived from sol-gel method, it is possible to apply a fine patterning to the thin film of ferroelectric substance, and a fine processing of the piezoelectric element of ferroelectric substance is achieved.

In this manner, as compared with the line head for ink-jet printer manufactured according to the prior arts, in the line head according to the invention, it is possible to apply a highly fine processing (including small-sized nozzles, minute nozzle pitch, very fine ink passages) to the ink head portion. It is further possible to achieve a multicolor printing, as a result of fine patterning of the ferroelectric substance thin film of the piezoelectric element of ferroelectric substance which controls the ink head portion, and not only the reproduction of original image with fidelity but also a high speed printing can be achieved.

In effect, in the line head for ink-jet printer according to claim 1, fine processing of the ink nozzles and the ink passages becomes possible, and in the line head according to claim 3, fine patterning of the thin film of ferroelectric substance becomes possible, which makes it possible to achieve a fine processing of the piezoelectric element of ferroelectric substance. Consequently, in the invention, since a highly fine line head can be manufactured, it is possible to provide an ink-jet printer capable of performing a high speed printing and a high print quality.

Other objects, features and advantages of the invention will become apparent in the course of the following description with reference to the accompanying drawings.

DESCRIPTION OF THE PREFERRED EMBODIMENT

A preferred embodiment of the present invention is hereinafter described with reference to the drawings.

Figure 1:
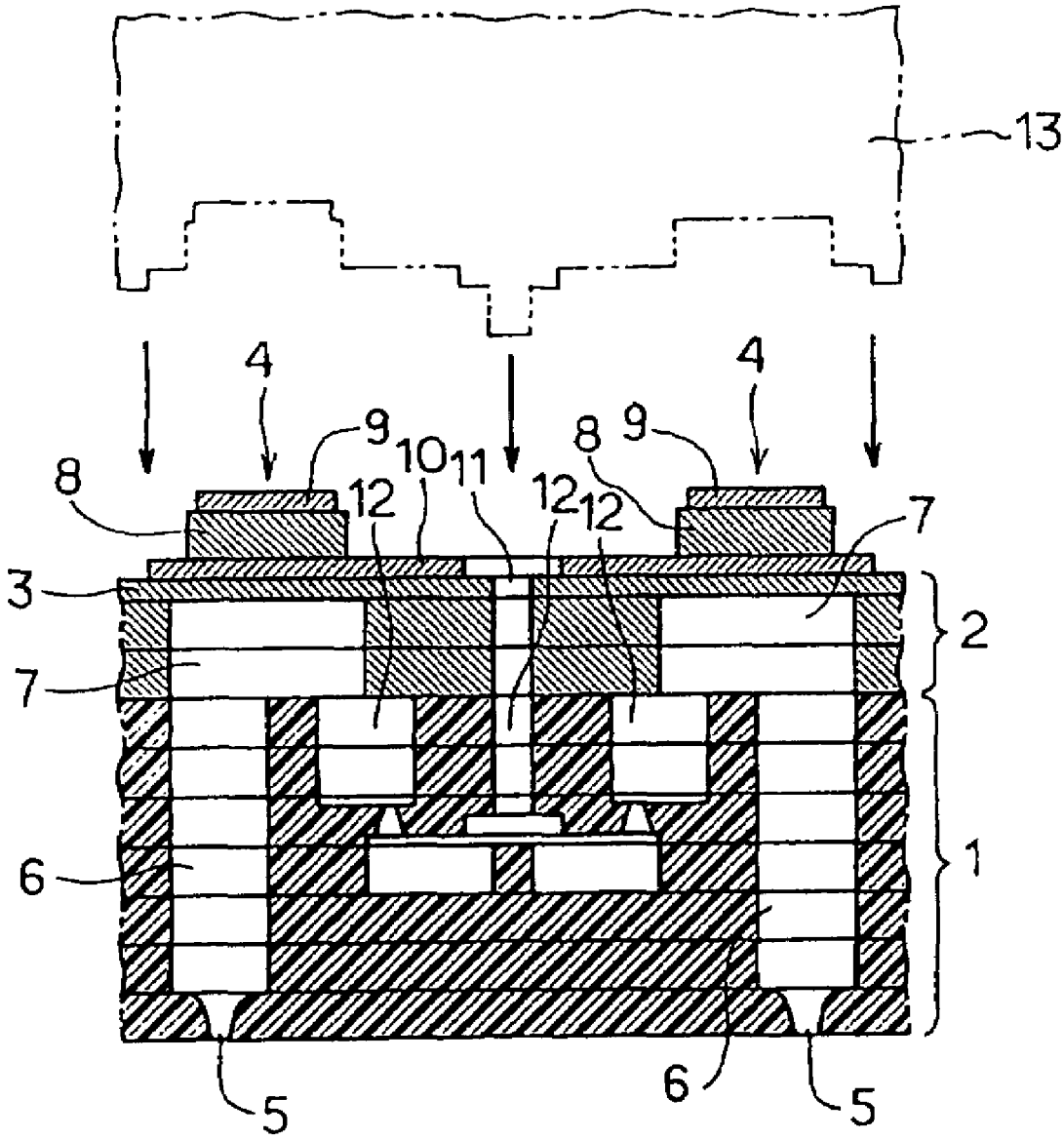
FIG. 1 is a partially enlarged sectional view showing a line head for an ink-jet printer according to example 1 of the present invention.
Figure 2:
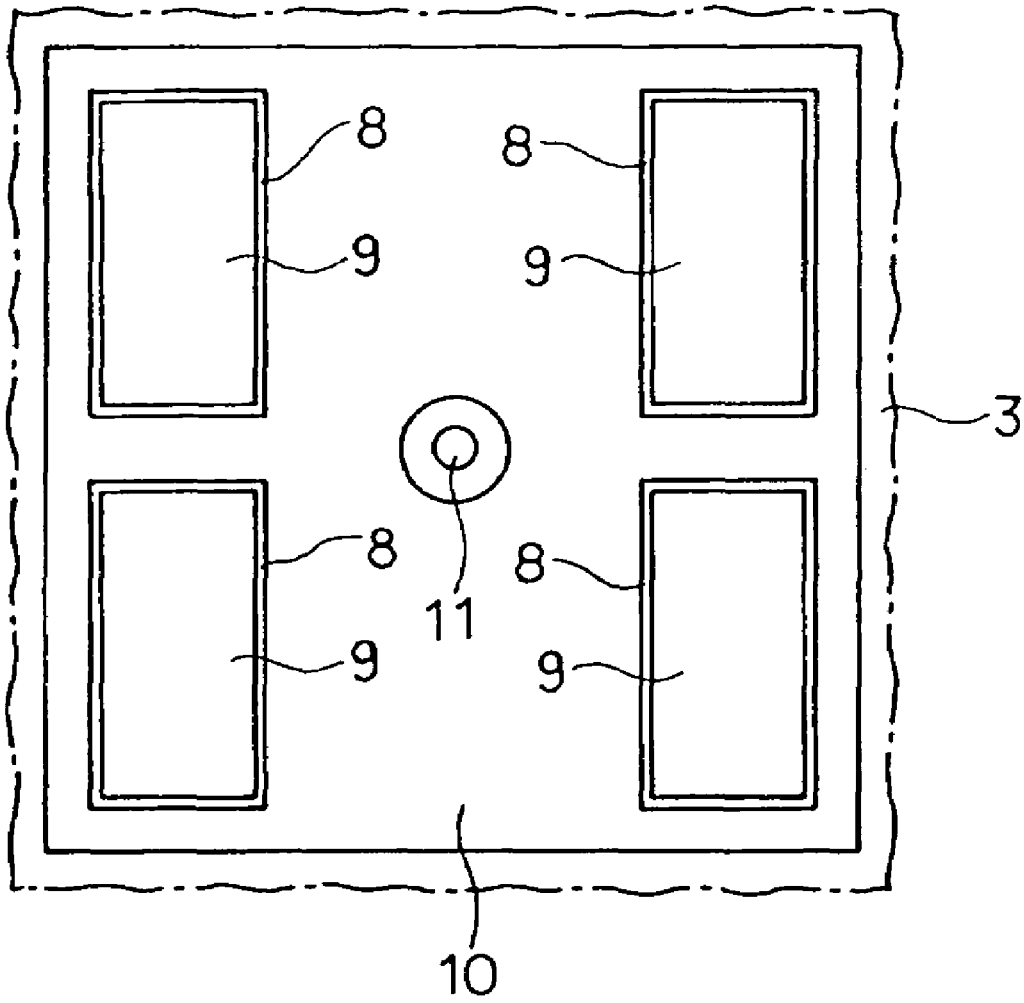
FIG. 2 is a partially enlarged plan view showing the line head shown in FIG. 1 from piezoelectric element side (upper side in FIG. 1).
Figure 3:
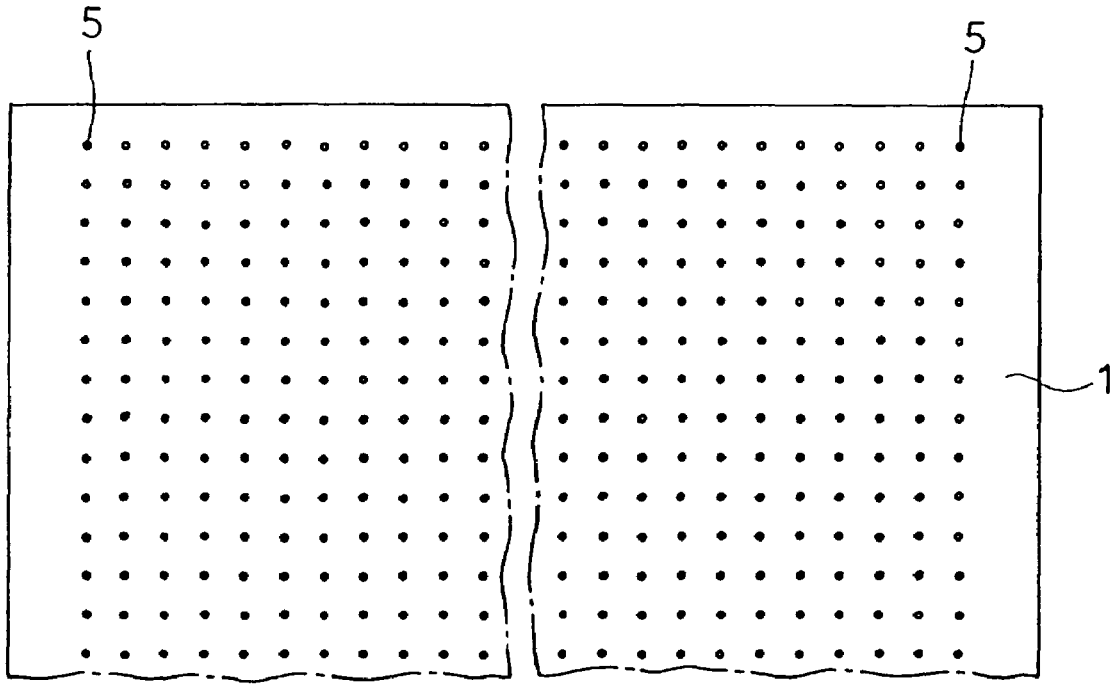
FIG. 3 is a plan view showing the entire line head shown in FIG. 1 from ink nozzle side.
Figure 4:
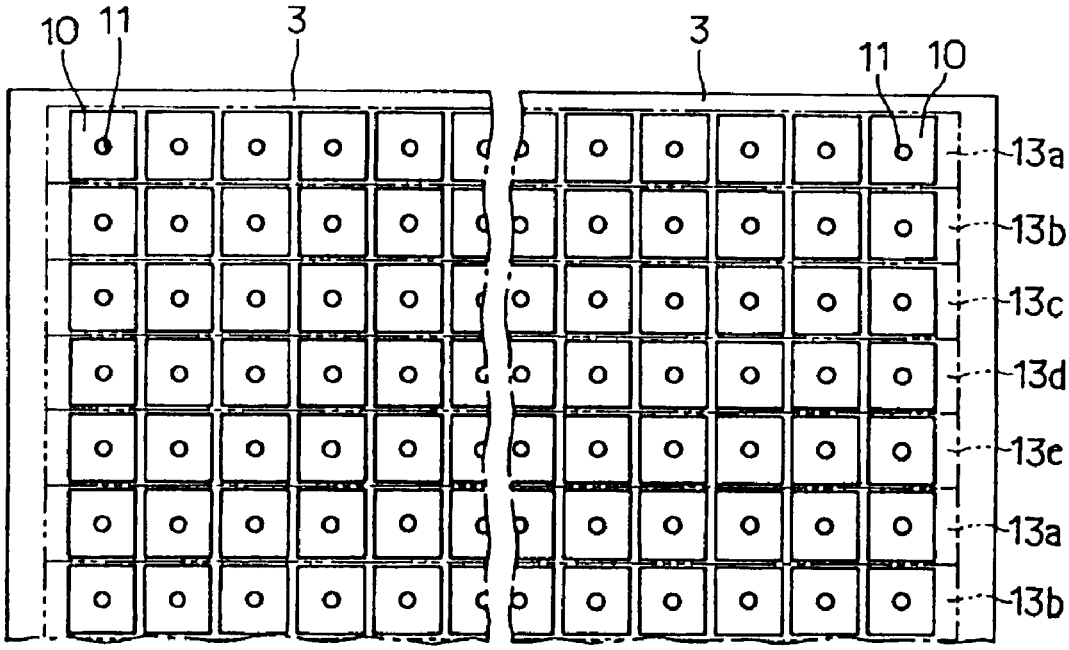
FIG. 4 is a plan view showing the entire line head shown in FIG. 1 from piezoelectric element side.

FIGS. 1 to 4 show an embodiment of the invention respectively, and in which FIG. 1 is a partially enlarged sectional view showing a line head for an ink-jet printer, FIG. 2 is a partially enlarged plan view showing the line head from piezoelectric element side (upper side in FIG. 1), FIG. 3 is a plan view showing the entire line head from ink nozzle side, and FIG. 4 is a plan view showing the entire line head from piezoelectric element side. However, FIG. 4 is a plan view with an ink tank removed, and illustration of the piezoelectric element is omitted therein.

This line head for ink-jet printer is formed by adhering a silicon substrate 1 and an inorganic thin film substrate 2 such as zirconia, silicon to each other, and by providing a piezoelectric element 4 of ferroelectric substance on the inorganic thin film substrate 2 side. The inorganic thin film substrate 2 is formed by laminating a plurality of thin plates, and a thin plate in contact with the piezoelectric element 4 of ferroelectric substance serves as a vibration plate 3. In the silicon substrate 1, a plurality of ink nozzles 5 are formed, and ink passages 6 communicating separately to respective ink nozzles 5 are formed in the silicon substrate 1. Pitch of the ink nozzles 5 is more or less 20 μm, for example. In the inorganic thin film substrate 2, ink chambers 7 separately communicating to respective ink passages 6 are formed. Further in the silicon substrate 1 ink, an ink supply port 11 is formed, and in the inorganic thin film substrate 2, ink passages 12 are formed for communication between the ink supply port 11 and the ink chambers 7.

Ink tanks 13 are mounted on the inorganic thin film substrate 2 side in such a manner as to cover the entire substrate, and an ink is supplied from the ink tanks 13 to the ink supply port 11, so that the ink may be lead to the ink chambers 7 through the ink passages 12. As indicated by the two-dot chain line in FIG. 4, each ink tank 13 is formed like a bar, and a multiplicity of ink tanks for different five colors comprising ink tank 13*a* for cyan, ink tank 13*b* for yellow, ink tank 13*c* for magenta ink tank 13*d* for light cyan and ink tank 13*e* for light magenta are arranged in order in one direction to cover the inorganic thin film substrate 2 side.

The piezoelectric element 4 of ferroelectric substance is constructed such that upper electrode patterns 9 and lower electrode patterns 10 are formed on both sides of a ferroelectric substance layer 8. Pitch provided on the piezoelectric element 4 of ferroelectric substance is more or less 20 μm which is equivalent to that of the ink nozzles 5.

The silicon substrate 1 is formed by lamination of a plurality of thin films prepared by plasma etching. On the other hand, the piezoelectric element 4 of ferroelectric substance is formed by putting the ferroelectric substance layer 8 prepared by fine patterning of a ferroelectric substance gel thin film formed by sol-gel method with optical fabrication between the upper electrode pattern 9 and the lower electrode pattern 10.

In the optical fabrication of the ferroelectric substance gel thin film, following three methods are preferably employed. In the first method, a photosensitivity is given to a ferroelectric substance gel thin film and a binder, and a coating solution (photosensitive paste) containing them is applied to a substrate. Thereafter, the coating film is exposed through a photomask, and portions of the coating film not exposed are removed using developing solution, thus a patterning being performed. In the second method, a polymer coating film or a gel film partially crystallized is formed as a protective film on a precursor gel film of ferroelectric substance, and a patterning utilizing a special development with water or the like is performed. In the third method, a mold is preliminarily prepared using a dry film, and a precursor sol of ferroelectric substance is injected into the mold to prepare a pattern. This third method is a method for forming a fine pattern by controlling wettability on the pattern surface of the dry film.

A manufacturing process of the piezoelectric element 4 of ferroelectric substance is hereinafter specifically described showing a case of using PZT (lead zirconate and titanete: Pb(Zr, Ti)O3) as a ferroelectric substance material, for example. First, a photosensitive paste was applied to a substrate to have a thickness of 10 μm on which patterning of platinum (Pt) electrode was performed, and then dried at a temperature of 100° C. for 30 minutes. This photosensitive paste is composed by containing following components, for example: 7.5 weight parts of hydroxypropyl cellulose (HPC-L) produced by Nippon Soda Co., Ltd., as a photopolymerization binder; 2.5 weight parts of polyethylene glycol dimethaacrylate 14EG, 2.5 weight parts of polyethylene glycol dimethaacrylate 9EG, and 2.5 weight parts of pentaerythritoltriacrylate all produced by Kyoyeisha Chemical, as a photopolymerization monomer; and 0.9 weight parts of Cure 1800 produced by Ciba-Geigy Limited, as an initiator of photopolymerization. Furthermore, the photosensitive paste contains also 85 weight parts of PZT-05L and 30 weight parts of ethylcellulosolve (solvent) produced by Kyoto Elex.

With respect to development by exposure, after an exposure for one minute at 30 mW/cm$^2$ using Masqualiner produced by Mikasa through a mask pattern, a development was performed by dipping in a distilled water for one minute. In this manner, a result of patterning having a line width of 1 μm-150 μm was obtained. The substrate was then subject to burning, and a PZT piezoelectric element was obtained.

Further, in the case that an optical patterning is achieved by introducing a photosensitive group into a hydroxyl group contained in the precursor sol of ferroelectric substance, using 65 weight parts of PZT-05L and 25 weight parts of PZT precursor sol both produced by Kyoto Elex as a photosensitive paste, a PZT piezoelectric element applied with a predetermined patterning was prepared in the same steps as described above. The precursor sol employed at this time was, for example, prepared in the following manner.

A stirrer for magnetic stirring is put in a two-liter round bottom flask with four mouths on which a dry pipe, a Dimroth condenser, a thermometer and a septum of silicon rubber are mounted. 0.1 mol (28.42 g) of tetraisopropoxytitanium is sampled into the flask, and dissolved in 500 ml of dehydrated isopropyl alcohol. 0.1 mol (1.80 g) of hydrochloric acid water of 0.001N is sampled into another vessel, and diluted in 500 ml of dehydrated isopropyl alcohol. A solution thus obtained is then dropped into the flask using a micro-tube pump. The drop speed at this time is about 4 ml/min. After mixing the solution in the flask, by heating with an oil bath, the mixed solution is refluxed for 8 hours, and naturally cooled after the reflux. A solution obtained in this manner is hereinafter referred to as solution A.

A stirrer for magnetic stirring is put in a two-liter round bottom flask with four mouths on which a dry pipe, a Dimroth condenser, a thermometer and a septum of silicon rubber are mounted. 0.1 mol (38.37 g) of tetranormalbutoxyzirconium is sampled into the flask, and dissolved in 400 ml of dehydrated isopropyl alcohol. 0.2 mol (20.02 g) of acetylacetone is dissolved in 100 ml of isopropyl alcohol, and a solution thus obtained is added to the tetranormalbutoxyzirconium solution. A mixed solution thus obtained is then stirred. The mixed solution is refluxed for 1 hour, and naturally cooled after the reflux.

0.1 mol (1.80 g) of hydrochloric acid water of 0.001N is sampled into another vessel, and diluted in 500 ml of dehydrated isopropyl alcohol. A solution thus obtained is then dropped into the flask using a micro-tube pump. The drop speed at this time is about 4 ml/min. After mixing the solution in the flask, by heating with an oil bath, the mixed solution is refluxed for 8 hours, and naturally cooled after the reflux. A solution obtained in this manner is hereinafter referred to as solution B.

0.033 mol (0.60 g) of hydrochloric acid water of 0.001N is diluted in 150 ml of dehydrated isopropyl alcohol, and the solution thus obtained is dropped into the solution A using a micro-tube pump. The drop speed at this time is about 4 ml/min. The mixed solution is stirred for 30 minutes at a room temperature. A solution obtained in this manner is hereinafter referred to as solution C.

The solution B is added to the solution C, and by heating with an oil bath, the mixed solution is refluxed for 2 hours, and naturally cooled after the reflux. A solution obtained in this manner is hereinafter referred to as solution D.

[Addition of Raw Material of Pb Alkoxide]

0.2 mol (65.26 g) of Pb2-aminoethoxy-acetate [Pb (NH2CH2 CH2o) (CH3COO)] is dissolved in 200 ml of dehydrated isopropyl alcohol, and a solution thus obtained is added to the solution D. By heating with an oil bath, the mixed solution is refluxed for 2 hours, and naturally cooled after the reflux.

Then, the obtained solution is concentrated up to a predetermined concentration at a temperature not higher than 70° C. using a rotary evaporator. In this manner, a PZT precursor sol was obtained.

Comparing number of ink nozzles between the line head according to the prior art and that according to the invention, 6 per head in the prior art (chemical etching), while 30 per head in the working technique (plasma etching) according to the invention. Further, comparing L/S (line/space) in the PZT patterning between the prior art and the invention, 300 μm L/S in the PZT paste according to the prior art, while 20 μm L/S in the sol-gel PZT+photosensitive material according to the invention.

What is claimed is:

1. A head for ink-jet printer comprising:

a silicon substrate in which a plurality of ink nozzles and a plurality of ink passages each communicating separately to each of the ink nozzles are formed;

an inorganic substrate which is joined with said silicon substrate and is provided with ink chambers each communicating separately to each of the ink passages; and a piezoelectric element of ferroelectric substance for changing separately a capacity of each of the ink chambers to jet an ink from said ink nozzles through said ink passages, wherein said silicon substrate includes a structure in which a plurality of silicon substrates of equal thickness are laminated;

wherein said ink passages are fine as compared with said ink chambers and said ink nozzles are fine as compared with said ink passages, wherein said inorganic substrate has a common ink supply port for supplying ink to said plurality of ink passages at a portion on a surface of said inorganic substrate between a plurality of said piezoelectric elements, wherein said ink nozzles are disposed two-dimensionally side by side on a silicon substrate located on the most upper surface of said plurality of silicon substrates, wherein a plurality of said common ink supply ports are disposed two-dimensionally side by side on said inorganic substrate, and wherein a plurality of ink tanks commonly supplying ink to each of said common ink supply ports disposed side by side in one direction are disposed along the direction perpendicular to said one direction.

2. The head for ink-jet printer of claim 1, wherein said ink nozzles and said ink passages are processed finely using a plasma etching method.

3. The head for ink-jet printer of claim 1, wherein said ink nozzles have tapered configurations.

4. The head for ink-jet printer of claim 1, wherein said in nozzles and said ink passages are communicated by laminating the silicon substrate in which said ink nozzles are processed and the silicon substrate in which said ink passages are processed.

5. The head for ink-jet printer of claim 1, wherein colors of inks contained in said plurality of ink tanks are different from each other between one ink tank and another ink tank adjacent to the one ink tank.

* * * * *